US008328027B2

(12) United States Patent
Barkdoll

(10) Patent No.: US 8,328,027 B2
(45) Date of Patent: Dec. 11, 2012

(54) SELF CONTAINED RETAIL PUSHER

(75) Inventor: Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 161 days.

(21) Appl. No.: 12/369,120

(22) Filed: Feb. 11, 2009

(65) Prior Publication Data

US 2010/0200526 A1 Aug. 12, 2010

(51) Int. Cl.
*A47F 7/00* (2006.01)

(52) U.S. Cl. ..... 211/59.3; 211/184

(58) Field of Classification Search ..... 211/59.2, 211/59.3, 184, 90.01, 90.02, 51, 43, 59.4; 312/61, 71
See application file for complete search history.

(56) References Cited

U.S. PATENT DOCUMENTS

| | | | | | |
|---|---|---|---|---|---|
| 1,832,884 | A | * | 11/1931 | Ulrich | 211/43 |
| 1,910,046 | A | * | 5/1933 | Pascoe | 211/59.3 |
| 2,738,881 | A | * | 3/1956 | Michel | 211/59.3 |
| 2,855,258 | A | * | 10/1958 | Moncier | 312/140.3 |
| 3,235,092 | A | * | 2/1966 | Schwarz | 211/43 |
| 3,850,534 | A | * | 11/1974 | O'Halloran | 403/190 |
| 4,183,438 | A | * | 1/1980 | Huczek | 211/59.2 |
| 4,435,031 | A | * | 3/1984 | Black et al. | 439/82 |
| 4,606,465 | A | * | 8/1986 | Moustakas | 211/43 |
| 4,830,201 | A | * | 5/1989 | Breslow | 211/184 |
| 5,265,738 | A | | 11/1993 | Yablans et al. | |
| 5,450,969 | A | * | 9/1995 | Johnson et al. | 211/59.3 |
| 5,464,105 | A | * | 11/1995 | Mandeltort | 211/184 |
| 5,971,173 | A | | 10/1999 | Valiulis et al. | |
| 6,286,690 | B1 | | 9/2001 | Thalenfeld | |
| 6,427,858 | B2 | * | 8/2002 | Sabounjian | 211/202 |
| 6,769,552 | B1 | | 8/2004 | Thalenfeld | |
| 6,824,009 | B2 | | 11/2004 | Hardy | |
| 6,889,854 | B2 | | 5/2005 | Burke | |
| 6,923,330 | B1 | | 8/2005 | Nagel | |
| 6,964,235 | B2 | | 11/2005 | Hardy | |

(Continued)

FOREIGN PATENT DOCUMENTS

DE 20 2005 010 088 U1 10/2005

(Continued)

OTHER PUBLICATIONS

POS Tuning UDO Voβhenrich, The POS Product Pusher; http://www.postuning.de/69.0.html?&L=25/31/2006 11:51:42 AM, website, date last visited May 31, 2006, 1 page.

(Continued)

*Primary Examiner* — Korie Chan
(74) *Attorney, Agent, or Firm* — Reinhart Boerner Van Deuren P.C.

(57) ABSTRACT

A self contained retail pusher is provided. The self contained retail pusher is situated on a retail structure in a typical retail environment. The self contained retail pusher may be quickly incorporated into permanent or temporary retail structures such as retail shelves having existing adjacent dividers and a front fence without having to completely disassemble the shelf, dividers, and front fence. The self contained retail pusher also optimizes retail structure space usage by allowing the user to selectively incorporate a single self contained retail pusher or a plurality thereof in a retail structure. Due to its modularity and ability to mount separately and independently from an existing shelving divider system, the self contained retail pusher may be supplied as a stand alone unit, and without a new divider system.

18 Claims, 10 Drawing Sheets

U.S. PATENT DOCUMENTS

| | | | | |
|---|---|---|---|---|
| 7,424,957 | B1 * | 9/2008 | Luberto | 211/59.3 |
| 2005/0056602 | A1 | 3/2005 | Hardy | |
| 2005/0092703 | A1 * | 5/2005 | Mueller et al. | 211/59.3 |
| 2005/0189309 | A1 | 9/2005 | Hardy | |
| 2005/0218094 | A1 * | 10/2005 | Howerton et al. | 211/59.3 |
| 2007/0187344 | A1 * | 8/2007 | Mueller et al. | 211/59.3 |
| 2007/0256992 | A1 * | 11/2007 | Olson | 211/59.3 |
| 2007/0267364 | A1 | 11/2007 | Barkdoll | |

FOREIGN PATENT DOCUMENTS

| | | | |
|---|---|---|---|
| EP | 1 256 296 | A2 | 11/2002 |
| EP | 1 541 064 | A1 | 6/2005 |
| GB | 2 360 514 | A | 9/2001 |
| WO | WO 2004/083051 | A2 | 9/2004 |

OTHER PUBLICATIONS

POS Tuning UDO Voβhenrich, The POS Systemtray; http://www.postuning.de/69.0.html?&L=25/31/2006 11:55:00 AM, website, date last visited May 31, 2006, 1 page.

* cited by examiner

SELF CONTAINED RETAIL PUSHER

FIELD OF THE INVENTION

This invention generally relates to retail pusher systems, and in particular, to a pusher system employed to front face retail merchandise.

BACKGROUND OF THE INVENTION

To ensure that retail merchandise stocked upon a retail shelf is suitably presented to a potential customer, it is desirable to situate the merchandise in a neat orientation near the front edge of the retail shelf by "facing" the merchandise. Examples of merchandise that is typically faced include beverage containers and digital video discs. The process of facing often involves sliding the merchandise, which is typically situated upon a retail shelf in rows, toward a front edge of the shelf. Merchandise may be manually faced by hand by store employees, or self-faced using a mechanical apparatus generally known in the art as a pusher system. Manually facing merchandise is a tedious and time consuming chore for store employees that must be performed often, and therefore results in the inefficient use of labor. Pusher systems offer the advantage of reducing inefficiency in the work place, and therefore there is a growing desire to incorporate pusher systems into a variety of new and existing retail environments.

Typically, a pusher system includes a front fence, a number of dividers and multiple pushers. To face the merchandise using the pusher system, the merchandise is loaded into a channel defined by two or more adjacent dividers. The dividers assist in maintaining the merchandise in a linear row within the channel. A pusher, also situated within the channel and movable toward and away from the front fence, biases the row of merchandise forward until the front most unit of merchandise is in engageable contact with the front fence at the front edge of the retail shelf. The front fence, dividers, and pushers of a pusher system thus work in combination to face the retail merchandise along a retail shelf. A typical pusher system is a moderately complex assembly that includes multiple pushers and multiple dividers commonly connected to the front fence. The pushers, dividers, and front fence are typically designed in a custom fashion such that the components are not interchangeable with other pusher systems. An exemplary design of such pusher systems describe above is shown in U.S. Patent Application Publication US 2007/0267364 assigned to the present assignee.

There continues to be a large number of retail environments where merchandise is inefficiently faced manually because of the large amounts of capital initially invested in shelving and divider systems that do not employ pusher systems. Therefore, there is a growing need for the ability to quickly and efficiently incorporate the benefits of a pusher system into these retail environments without also replacing the existing components of the shelving and divider systems used therein. Moreover, there is a need for retail display systems that can optimize retail space usage due to the increasing stratification of merchandise offered in a retail environment. The present invention is directed at providing a solution to one or more of these issues.

BRIEF SUMMARY OF THE INVENTION

The present invention has several aspects that may be claimed and stand as patentable independently and individually or in combination with other aspects, including but not limited to the following.

In one aspect, the present invention provides an apparatus for self-facing merchandise in the form of a pusher assembly that can be quickly and efficiently incorporated into existing retail environments by securing the pusher assembly itself to the retail environment via a fastener attachment. According to this aspect, an embodiment of the invention includes a pusher body, a mounting plate, a spring acting upon the pusher body and the mounting plate through extension and retraction of the spring, and at least one fastener (e.g. such as a pin, multi-pin, nut-bolt arrangement, screw, or other fastener member) adapted to secure the mounting plate in the retail environment (e.g. such as to a retail shelf or a corrugated temporary display). Accordingly, the pusher assembly can be mounted directly to a retail shelf retail using only a fastener. As such, the pusher assembly is supplied without any additional components, e.g. a divider system, and allows the user to retrofit a self-facing system in an existing retail environment without the need to also replace other components such as the existing divider system. This aspect can also be employed in new systems as well, and is not limited to retrofits. As a result, this aspect provides a cost effective and efficient solution for incorporating a self-facing system, i.e. a pusher system, into existing and new shelving systems.

One particularly advantageous fastener is a push pin that requires no special installation tools, whereby a user installs the push pin by hand. The push pin embodiment of the fastener snaps in and out of the retail shelf with ease, ultimately reducing the time and required skill level in installing the apparatus.

In another inventive aspect, the present invention provides an apparatus for self-facing merchandise in a retail environment that retrofits existing systems or otherwise allows versatility and modularity by mounting the apparatus independently and separate from an existing shelf divider system. According to this aspect, an embodiment of the invention includes a retail shelf adapted to support retail merchandise, a shelf divider system mounted to the shelf having at least two divider walls extending rearwardly away from a front edge of the shelf, and a pusher mounted to the shelf independently and separate from the shelf divider system. The pusher is comprised of a pusher body, a mounting plate, a spring acting on the pusher body and the mounting plate, whereby the pusher body is movable toward and away from the mounting plate through extension and retraction of the spring.

In a yet another aspect, the invention provides a method for self-facing retail merchandise in a retail environment. According to this aspect, an embodiment of the invention comprises the steps of securing a pusher directly to a retail environment using a fastener to operably connect a mounting plate of the pusher directly to the retail environment, loading retail merchandise into a channel defined by two adjacent dividers, wherein the pusher assembly is interposed between the adjacent dividers. A pusher body of the pusher assembly is moved away from the mounting plate when loading the retail merchandise, by sequentially placing the retail merchandise in a row disposed of in front of the pusher.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
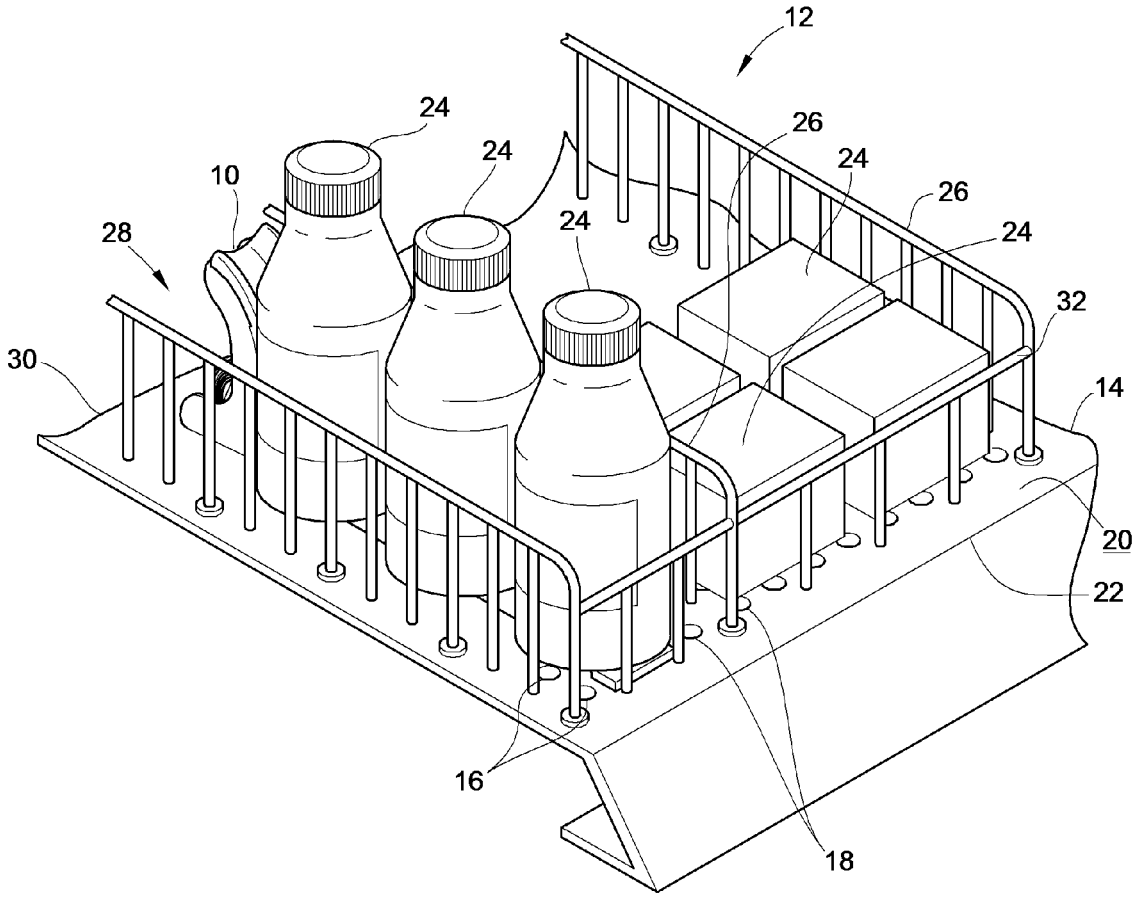
FIG. 1 is an isometric view of an exemplary embodiment of a self contained retail pusher in a retail environment in combination with a shelf and separate divider system in accordance with the teachings of the present invention.

Referring to FIG. 1, an embodiment of an apparatus for self-facing retail merchandise in the form of a pusher assembly 10 is illustrated. As illustrated, the pusher assembly 10 is integrated into a typical retail environment 12. In the illustrated embodiment, the retail environment 12 includes a sheet metal retail shelf 14 and dividers 26, but in other embodiments, the retail environment 12 may include other retail structures including but not limited to seasonal or temporary corrugated displays. In one embodiment of the invention, the pusher assembly 10 is supplied independent of any retail structure, and in other embodiments, the pusher assembly 10 can include and function synergistically with a variety of retail structures.

The shelf 14 may include parallel rows 16 of apertures 18 extending through the top surface of the shelf 14. The rows 16 of the apertures are typically in proximity to a front edge 22 of the shelf 14. Merchandise 24 is situated on a top surface 20 of the shelf 14, and separated by dividers 26. The pusher assembly 10 is situated between adjacent dividers 26 in a channel 28. The pusher assembly 10 is movable within the channel 28 between the front edge 22, and a rear edge 30 of the shelf 14. As will be discussed in greater detail below, the pusher assembly 10 biases a row of the retail merchandise 24 toward a common front stop 32 (e.g. in the form of a wire fence, or a alternatively plastic fence such as a transparent wall).

For the sake of simplicity, the description will be drawn to a relatively simple embodiment having a single pusher assembly 10 situated between two adjacent dividers 26. However, it will be understood that a plurality of pusher assemblies 10 may be situated respectively and independently between multiple adjacent dividers 26. Each set of adjacent dividers 26 can define a channel 28 of different or the same width as the last, and any given channel 28 may incorporate more than one pusher assembly 10.

Figure 2:
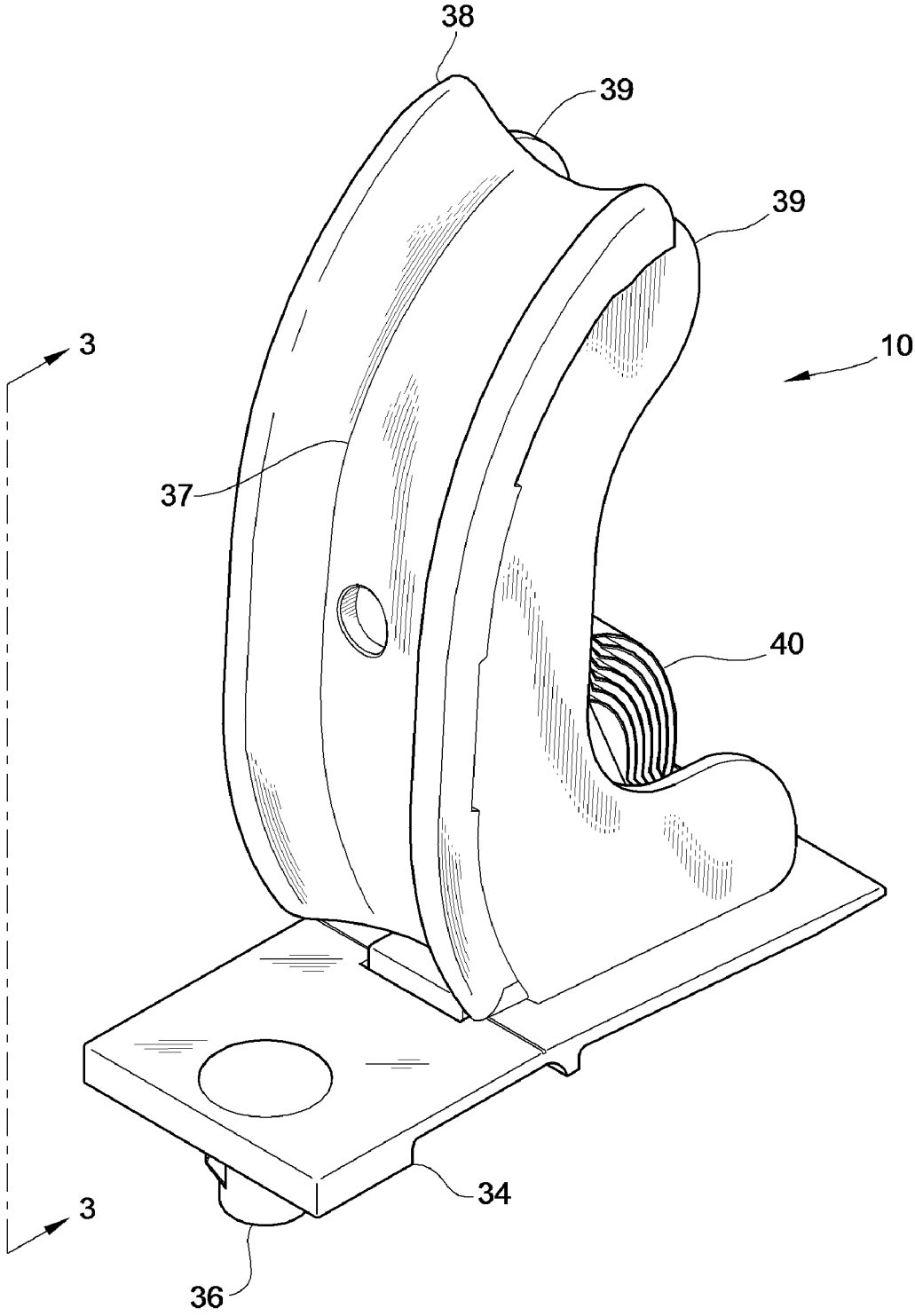
FIG. 2 is an isometric view of the self contained retail pusher used in the retail environment shown in FIG. 1.

Referring now to FIGS. 1 and 2, the pusher assembly 10 is illustrated as including a mounting plate 34, a fastener such as a pin 36, a pusher body 38, and a spring 40. The pusher body 38 is movable toward and away from the mounting plate 34, which is fixed to the shelf 14 by the pin 36. It will be recognized that although a pin 36 is illustrated, other types of fasteners (e.g. such as a pin, multi-pin, nut-bolt arrangement, screw, or other fastener member) may also be used to fix the mounting plate 34 to the shelf 14.

In the illustrated embodiment, and as will be discussed in more detail below, the spring 40 is contained in the pusher body 38 with a free end 42 (see FIG. 3) affixed to the mounting plate 34. The spring 40 is dispensed from the pusher body 38 when moving the pusher body 38 away from the mounting plate 34. Once dispensed, the spring 40 acts upon the pusher body 38 to bias it forward. As a result, any merchandise 24 in engageable contact with the pusher body 38 in the channel 28 is also biased forward until the front most item of merchandise 24 engages the front stop 32 as shown. When the front most item of merchandise 24 is removed from the channel 28 by a consumer, the row of merchandise 24 is again biased forward and a portion of the spring 40 is retracted into the pusher body 38 until the next item of merchandise engages the front stop 32.

Figure 3:
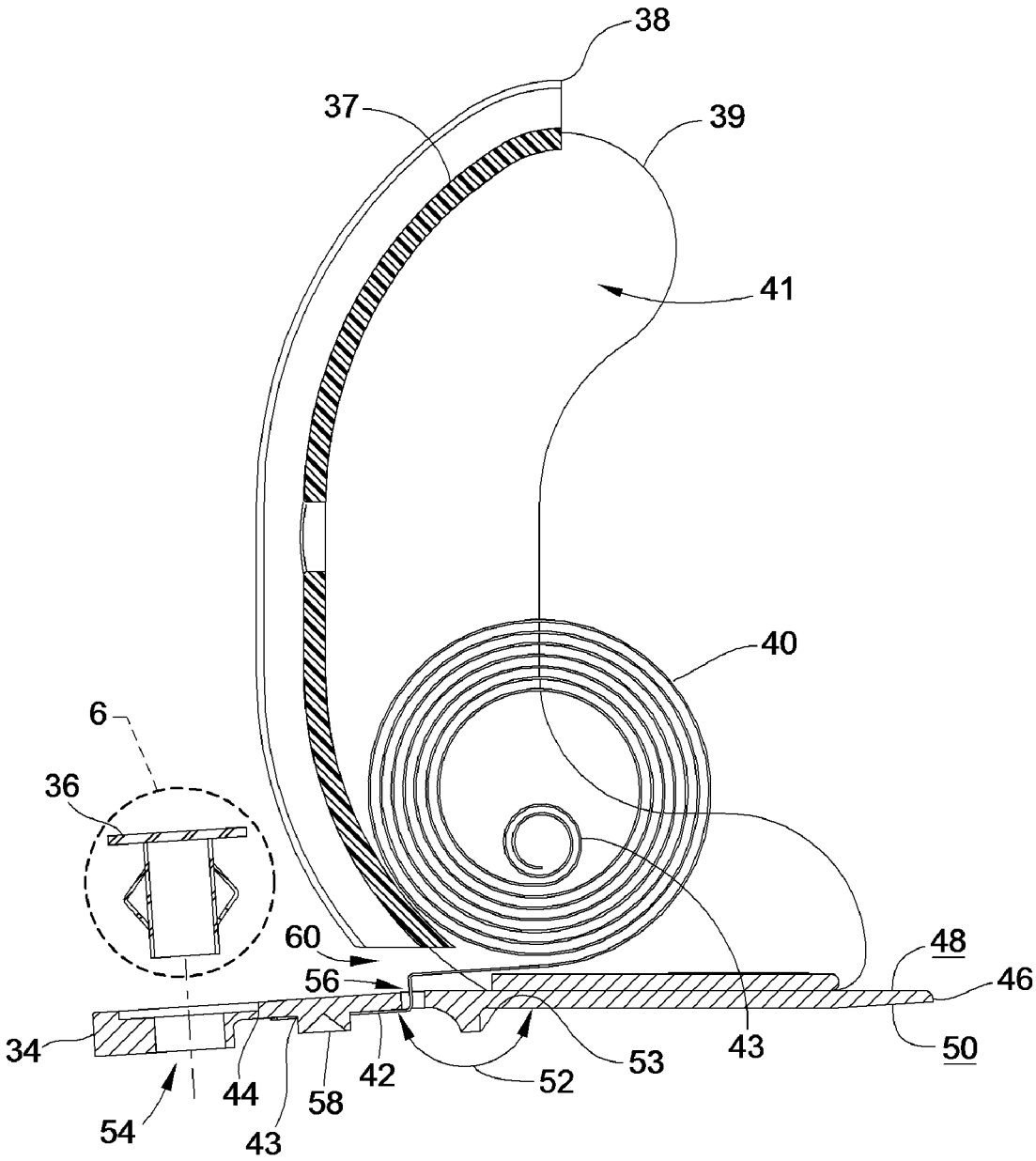
FIG. 3 is a side cross sectional view of the self contained retail pusher of FIG. 2.

Referring now to FIGS. 2 and 3, the pusher body 38 has a front wall 37, and a pair of side walls 39 extending transversely away from the front wall 37. The front and side walls 37, 39 together form a spring chamber 41 for receipt and housing of the spring 40. As illustrated in FIG. 3, the spring 40 may be supplied as a coil spring having a variable coil diameter.

The variable coil diameter of the spring 40 begins at an end of the spring 40 opposite the free end and increases in diameter as the spring is coiled. The coil spring 40 has a substantially reduced diameter portion 43 at the start of the coil in order to prevent the coil spring 40 from becoming displaced from the pusher body 38 when the pusher body 38 is fully retracted away from the mounting plate 34. As such, the spring 40 is coiled such that the pusher body 38 may be freely retracted away from the mounting plate 34 by hand, thereby unwinding the spring 40 up to the substantially reduced coil diameter, i.e. diameter portion 43. The substantially reduced coil diameter portion 43 will not unwind freely by hand, and therefore the it will not pass through the pusher body opening 60 extending through the front wall 37 of the pusher body 38, and thus the spring 40 is prevented from becoming displaced from the pusher body 38.

Turning now to FIG. 3, a cross section of the pusher assembly 10 is illustrated, showing the mounting plate 34 in greater detail. The mounting plate 34 has a generally rectangular periphery, and serves as the interface between the pusher assembly 10 and the shelf 14, and in other embodiments, serves as the interface between the pusher assembly 10 and a temporary retail structure, such as a corrugated display. The mounting plate 34 has a front portion 44, and a rear portion 46. The front and rear portions 44, 46 extend between top and bottom surfaces 48, 50. An angle 52 is formed at the union of front and rear portions 44, 46. As a result of this angle 52, and as will be discussed in more detail below, the top surface 48 of the mounting plate 34 is ramped such that retail merchandise is biased angularly away from the shelf 14 and onto the top surface 48 of the mounting plate 34 during normal operation of the pusher assembly 10. The mounting plate 34 may be made of a transparent or opaque formed plastic, or any other suitably rigid material.

The front portion 44 of the mounting plate 34 includes a hole 54 that configured to receive the pin 36. The hole 54 extends between top and bottom surfaces 48, 50, and has a bore designed to accommodate the general shape of the pin 36. As illustrated, the hole 54 is a counter-bored hole, but in other embodiments, the hole 54 may be a simple hole, or any other similar structure designed to mate with any corresponding fastener. Additionally, the hole 54 may have an oval or generally slotted profile so that the pin 36 may be mounted off center of the mounting plate 34. When the mounting plate 34 is supplied with an oval or slotted hole 54, the mounting plate may be adjusted relative to the shelf 14 by locating the pin at a desired location within the slotted hole 54. Therefore, a user may finely adjust the pusher body 38 relative to the mounting plate 34 to accommodate merchandise of differing size and shape when the pusher assembly 10 is supplied with an oval or slotted opening 54. Also, the hole 54 may be omitted entirely, and the pin 36, or any other like fastener, may be unitarily formed with the front portion 44 of the mounting plate 34.

The front portion 44 also includes a slotted opening 56 and a retaining feature 58 for the respective routing and mechanical connection of the spring 40. The free end 42 of the spring 40 extends outwardly away from the pusher body 36 and through the pusher body opening 60. The free end 42 then passes through the slotted opening 56, and is mechanically connected to the retaining feature 58. The slotted opening 56 extends between top and bottom surfaces 48, 50. The free end 42 is then connected to the retaining feature 58 by virtue of a hole formed in the free end 42. As illustrated, the free end 42 and the retaining feature 58 are in a sliding fit relation, but in other embodiments, the free end 42 of the spring 40 and the retaining feature 58 may be coupled together via welding, brazing, heat staking, etc.

Still referring to FIG. 3, the rear portion 46 of mounting plate 34 extends generally transverse to the front portion 44 by virtue of the angle 52 there between. The rear portion 46 functions to ramp merchandise 24 upward and toward the front stop 32 (see FIG. 1) when the angle 52 is less than 180°. The rear portion also supports the pusher body 38 when the pusher body 38 is biased completely forward by the spring 40. Although illustrated with an angle 52 of less than 180°, in other embodiments mounting plate 34 may be supplied with an angle 52 approximately equal to 180° and therefore the front and rear portions 44, 46 are coplanar.

To ensure that the mounting plate 34 is rigid enough to ramp and support retail merchandise 24 as discussed above, the mounting plate may be supplied with a stabilizer in the form of a stabilizer rib 53 extending transversely away from the bottom surface 50 of the rear portion 46 of the mounting plate 34. The stabilizer rib 53 extends between the bottom surface 50 of the mounting plate 34 and the retail shelf 14, and is designed to prevent unwanted flexion of the mounting plate 34 when retail merchandise 24 is situated thereon. The stabilizer rib 53 may extend the width of the mounting plate 34, or in other embodiments, may encompass only a portion of said width.

Figure 4:
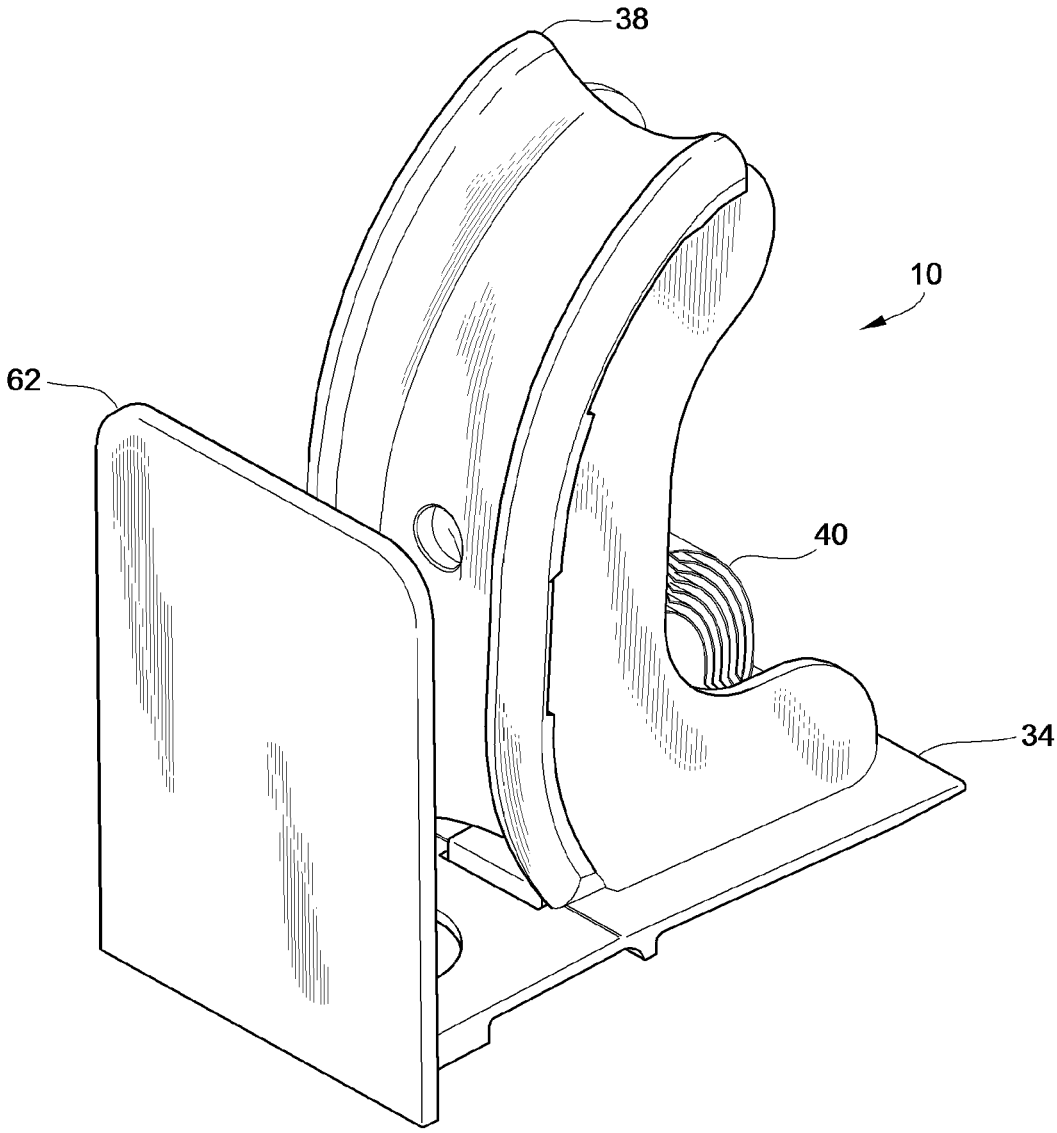
FIG. 4 is a perspective view of another embodiment of the self contained retail pusher similar to that of FIG. 3, but that incorporates an integral front stop sized for a single retail merchandise channel.

Turning now to FIG. 4, an alternative embodiment of a pusher assembly 10 is illustrated. In the illustrated embodiment, the mounting plate 34 also includes an integral front stop 62. The integral front stop 62 performs the same function as the front stop 32 in FIG. 1, and as will be discussed in greater detail below, allows the pusher assembly 10 to be incorporated with a simple existing retail structure, such as a shelf 14 utilizing existing dividers 26. The integral front stop 62 may be supplied in the form of wall extending transversely away from the mounting plate 34, and proximate to the front portion 44 thereof.

Figure 5:
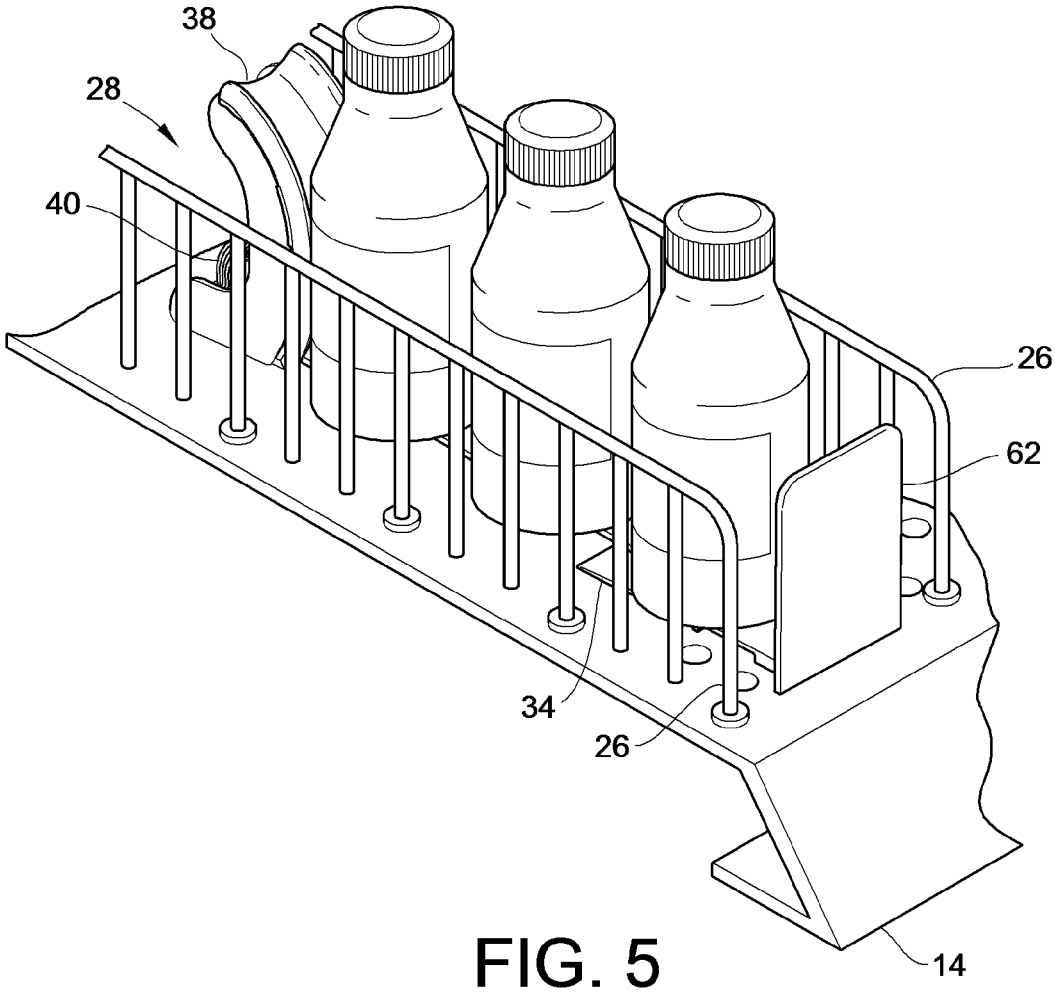
FIG. 5 is a perspective view the self contained retail pusher of FIG. 4 installed on a retail structure.

Referring now to FIG. 5, the pusher assembly 10 is illustrated with a retail shelf 14, and a pair of adjacent dividers 26. As can be recognized from the illustration, when incorporated into an existing retail shelf 14 having a pair of dividers 26, an embodiment of the invention allows a simple retail structure to be quickly reconfigured to front face merchandise 24. As illustrated, the integral front stop 62 is unique to each self contained retail pusher 10, and is narrower than the retail merchandise channel 28 (see FIG. 1) it is situated in. As a result, a plurality of self contained retail pushers 10 situated on a retail shelf 14 may each have an independent integral front stop 62, as opposed to a common front stop running a given length of the shelf 14. This feature allows a single or plurality of self contained retail pushers 10 to be incorporated into an existing shelving system that consists only of a shelf 14 and dividers 26, and thereby reconfigure the shelving system to be a self-facing system. Such reconfiguration may only require the additional hardware of a pin 36 or other fastener discussed below, and as such, allows an existing shelving system to be quickly and cost effectively reconfigured to self-face retail merchandise.

Figure 6:
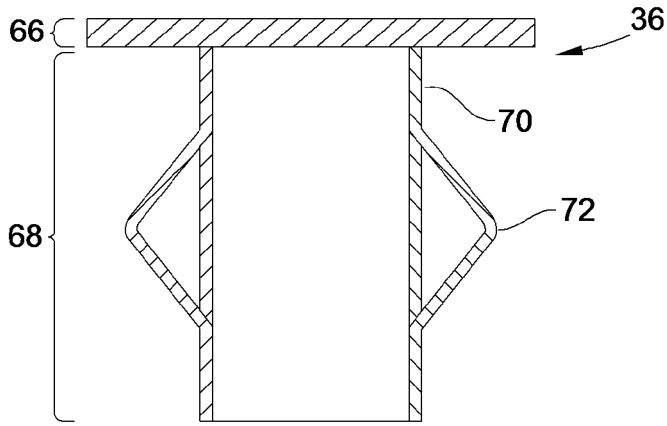
FIG. 6 is a side sectional view of a mounting pin of the self contained retail pusher of FIG. 3.

Turning now to FIG. 6, a fastener in the form of a pin 36 is illustrated. While a pin 36 is preferred and has advantages as discussed herein, other fasteners including but not limited to a pin, multi-pin, nut-bolt arrangement, screw, or other fastener member may also be used to affix the mounting plate 34 in the retail environment. Although an embodiment of the fastener is defined structurally as the pin 36, such a description is not a limitation, and it will be recognized that other types of fasteners may also be used.

As will be discussed in greater detail below, the pin 36 secures the mounting plate 34, and thus the pusher assembly 10, in the retail environment 12. The pin 36 includes a head portion 66, and a prong portion 68 extending transversely away from the head portion 66. The prong portion includes a neck segment 70, and a retaining segment 72. Although illustrated as independent of the mounting plate 34, the pin 36 may also be unitarily formed with the mounting plate 34 in other embodiments. The pin 36 is made of a transparent or opaque formed plastic, or any other suitably rigid material.

Figure 7:
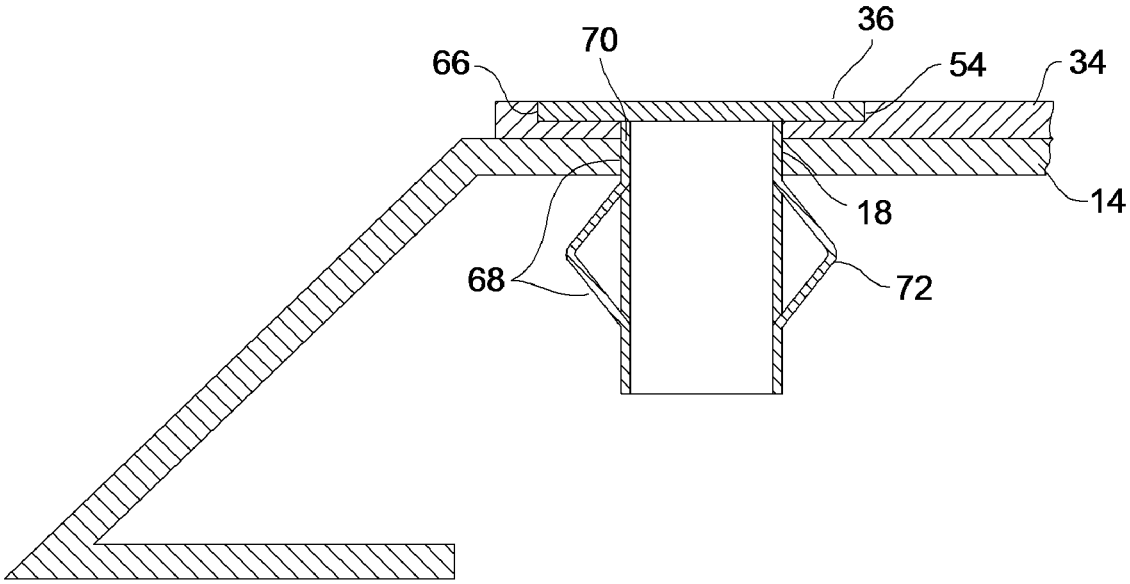
FIG. 7 is a fragmentary side cross-sectional view of the mounting pin of FIG. 6 installed in a retail shelf structure.

Referring to FIG. 7, the pin 36 is illustrated in an installed state, thereby securing mounting plate 34 to shelf 14. When installed, the head portion 66 is flush with the top surface 48 of the mounting plate 34. When the head portion 66 of the pin 36 is flush with the top surface 48 of the mounting plate, merchandise 24 (see FIG. 1) may be biased forward by the pusher body 38 until the merchandise 24 is disposed of above the pin 36. The prong portion 68 extends below the head portion 66, and passes through the mounting plate 34 and the shelf 14. When fully installed, neck segment 70 is within the corresponding bores of the hole 54 of the mounting plate 34, and the aperture 18 of the shelf 14.

The retaining segment 72 is disposed of below the shelf 14 when the pin 36 is fully installed. During installation of the pin 36, the retaining segment 72 deforms radially inward as it passes through the hole 54 and the aperture 18. Once the retaining segment 72 has passed through the hole 54 and the aperture 18, it returns to its original radially protruded state as illustrated. The retaining segment 72 is rigid enough to prevent the pusher assembly 10 from becoming unsecured during normal operation, but resilient enough to allow the pin 36 to be installed by hand. Although illustrated as having a radially protruding retaining segment 72, in other embodiments, the pin 36 may incorporate any feature that is rigid enough to secure the mounting plate 34 in a retail environment, but resilient enough to allow the pin 36 to be installed by hand. Also in other embodiments, the mounting plate 34 may have multiple holes 54, or a single hole 54 supplied with a slotted opening for the receipt of multiple pins 36. As describe above, the pin 36 may also be unitarily formed with the mounting plate 34.

In an alternative embodiment, the pusher assembly 10 may be affixed to a temporary retail structure, e.g. one made of a corrugated or other like material. In such an embodiment, the neck segment 70 of the pin 36 is contained within a bore of a punctured opening formed after forcing the pin 36 through the temporary retail structure. The retaining segment 72 deforms radially inward as it passes through the hole 54 and the punctured hole of the retail display. Once the retaining segment 72 has passed through the hole 54 and the punctured opening, it returns to its original radially protruded state as illustrated. As described above, the retaining segment 72 is rigid enough to prevent the pusher assembly 10 from becoming unsecured during normal operation, but resilient enough to allow the pin 36 to be installed by hand.

Figure 8:
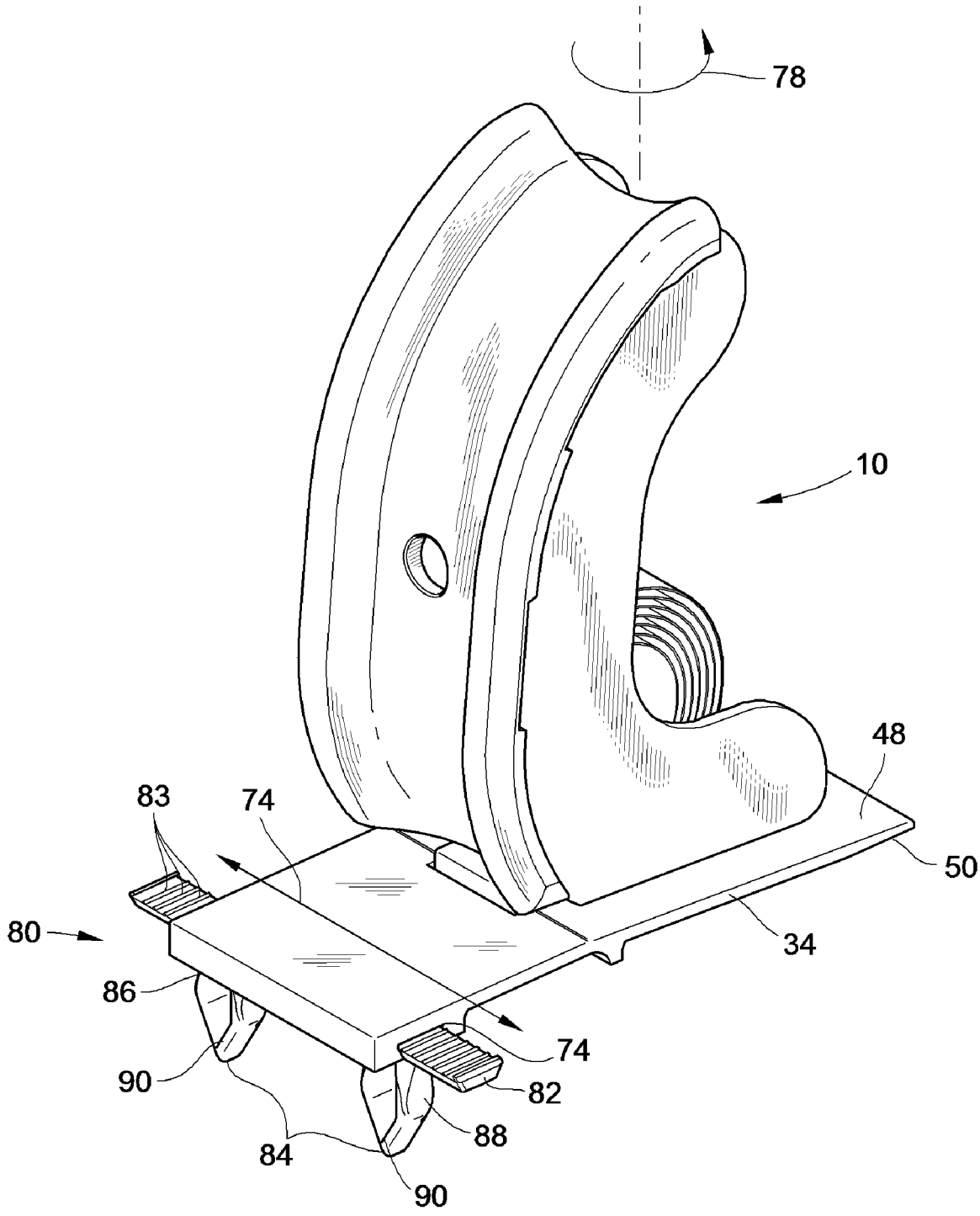
FIG. 8 is a perspective view of another embodiment of a self contained retail pusher similar to that of FIG. 1, but that incorporates a multi-pin slider device.

Turning now to FIG. 8, an alternative embodiment of the pusher assembly 10 is illustrated incorporating an adjustable multi-pin 80. The adjustable multi-pin 80 functions to affix the mounting plate 34 and thus the pusher assembly 10 in the retail environment 12. The adjustable multi-pin 80 has a head portion 82, and a plurality of prong portions 84 extending below the head portion 82. Each prong portion includes a neck segment 86 and a retaining segment 88. The retaining segment 88 terminates in a tapered end 90.

As illustrated, the head portion 82 may generally take the form of a rectangular prism or other similar structure, and is disposed within a channel 74 formed in the bottom surface 50 of the mounting plate 34. The head portion 82 and corresponding channel 74 are manufactured such that the head portion 82 of the multi-pin 80 is contained within the channel 74 during normal operation, but free to slide within the channel 74 along direction 76. The head portion may include a plurality of serrations 83 thereon, and the channel may in turn include a plurality of corresponding serrations to mate with the serrations 83 of the head portion 82. The serrations 83 act to define a finite number of lateral adjustment positions for multi-pin 80 within the channel 74. The multi-pin 80 is made of a transparent or opaque formed plastic, or any other suitably rigid material.

Figure 9:
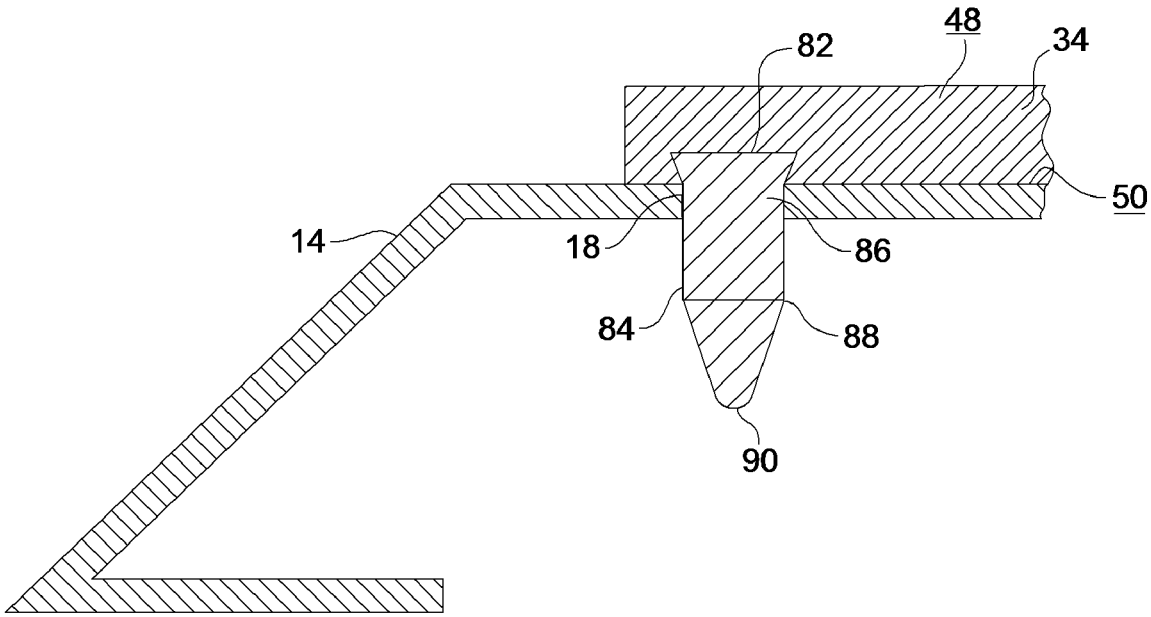
FIG. 9 is a sectional view of the self contained retail pusher of FIG. 8 that is installed on a shelf.

Referring to FIG. 9, the multi-pin 80 is illustrated in an installed state, thereby securing the mounting plate 34 to the shelf 14. The prong portions 84 are equally spaced along the head portion 82, and correspond to the equal spacing of the apertures 18 of the retail shelf 14. Although illustrated as utilizing a mounting plate 34 without an integral front stop 62 (see FIG. 4), in other embodiments, the multi-pin 80 may be included in a mounting plate 34 having an integral front stop 62.

Having defined the structure and several embodiments of the invention, a detailed description of how to use these embodiments is now provided.

Figure 10:
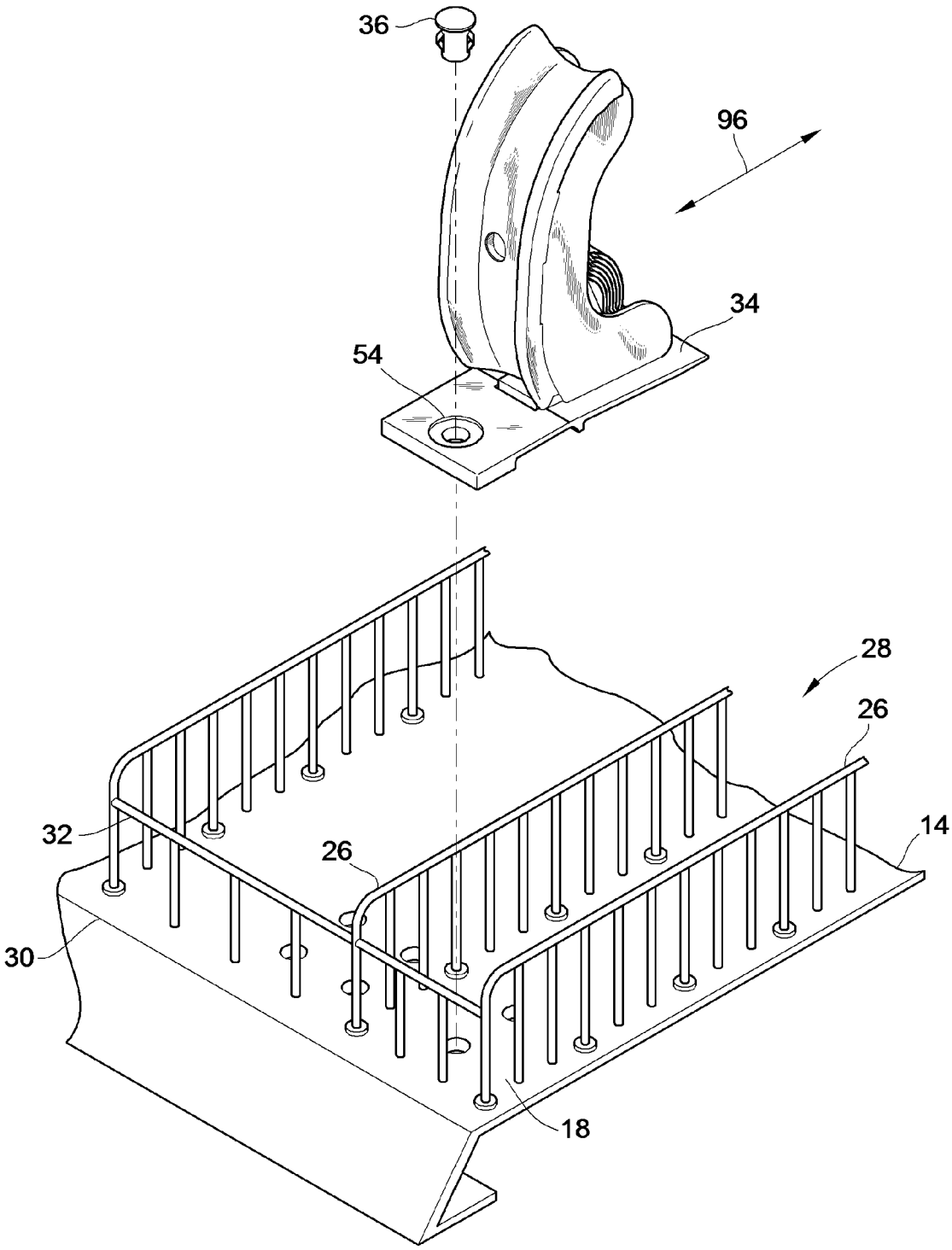
FIG. 10 is an assembly view of the self contained retail pusher and portions of the retail structure of FIG. 1.

Referring now to FIG. 10, an assembled view of an embodiment of the invention is illustrated which incorporates a single pin 36, and a retail shelf 14 having a plurality of apertures 18. To affix the mounting plate 34 to the retail shelf 14, the hole 54 and aperture 18 are first aligned. The pin 36 is then depressed through the aperture 54 of the mounting plate 34 and subsequently through the aperture 18. Although illustrated using a fastener that is a pin 36, in other embodiments, the mounting plate can be affixed in a similar fashion using other like fasteners, e.g. by passing a bolt through the mounting plate 34 hole 54 and the corresponding aperture 18, and threading the bolt onto a nut disposed of below the shelf 14.

As illustrated, the mounting plate 34, and as a result, the pusher body 38 and spring 40 are incorporated independently of any other mounting hardware and are affixed directly to the retail shelf 14 that incorporates an existing array of dividers 26. However, in other embodiments, the installation described above may be performed on a retail shelf 14 that does not incorporate any existing dividers 26. In such an embodiment, dividers 26 may be later installed or omitted entirely. Also, in an embodiment of the invention that incorporates an integral front stop 62, (see FIG. 4) the mounting plate 34 may be secured to the retail shelf 14 that only incorporates dividers 26 and is free from a pre-existing front stop 32.

Once installed, the pusher body 38 may be retracted away from the front edge 30 of the retail shelf by loading retail merchandise 24 (see FIG. 1) in a linear fashion into the channel 28 formed between the two adjacent dividers 26. With each subsequent addition of an item of merchandise 24, the pusher body 38 is moved away from the front edge 30 in direction 96. As described above, as each item 24 of merchandise is removed from the channel 28, the row of merchandise 24 is biased forward by operation of the pusher body 38 and spring 40 until the next item of merchandise 24 engages the front stop 32.

Figure 11:
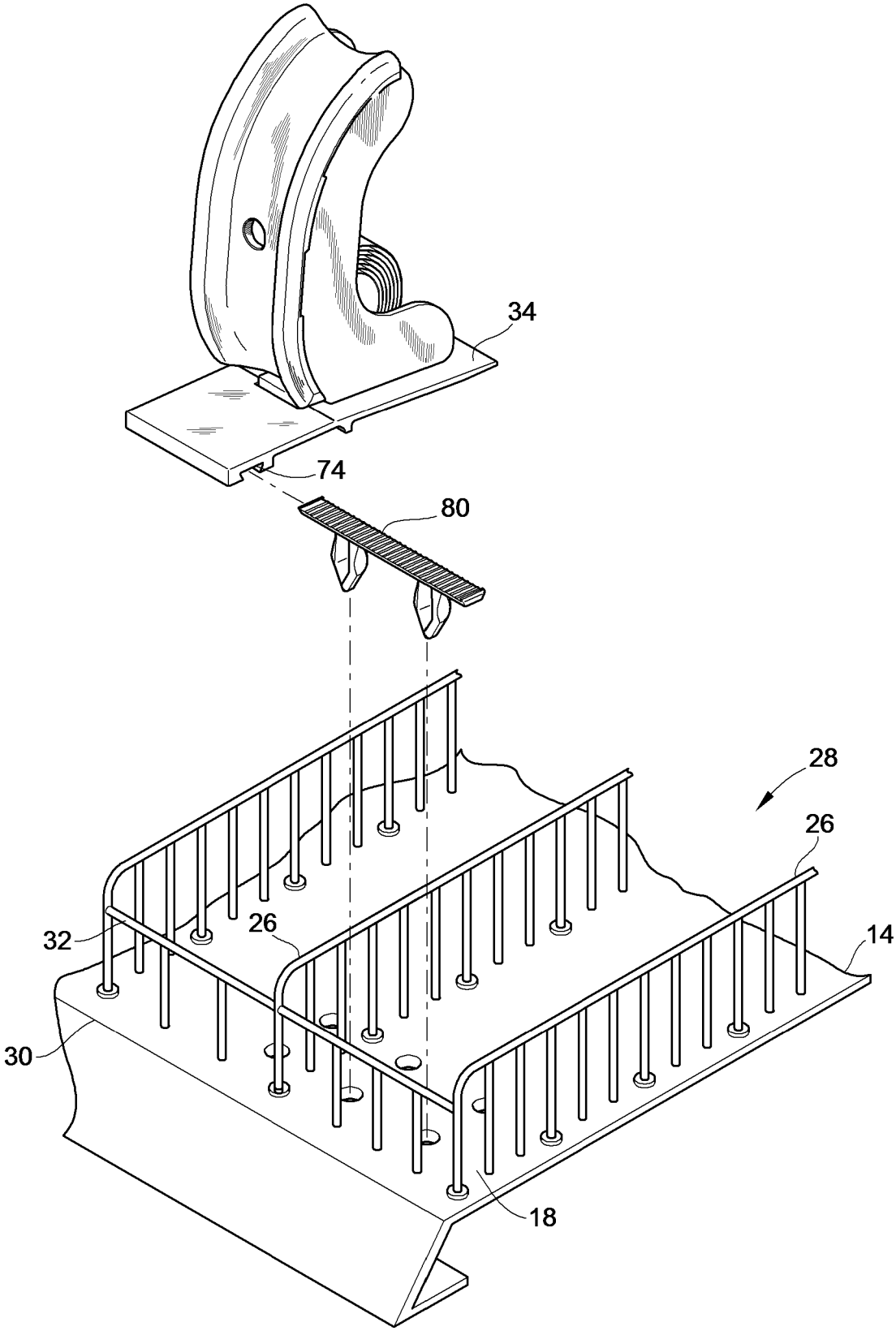
FIG. 11 is an assembly view of the self contained retail pusher and the retail shelf of FIG. 9.

Turning now to FIG. 11, the pusher assembly 10 is illustrated incorporating the multi-pin 80 and a typical retail shelf 14. The mounting plate 34 is secured to the retail shelf by first installing the multi-pin 80 in the channel 74, then aligning the prong portions 84 with the apertures 18 of the retail shelf 14, and applying sufficient force to resiliently snap the prong portions 84 through the apertures 18. A user may then, if so desired, finely adjust the lateral positioning of the pusher assembly 10 by sliding the mounting plate 34 relative to the adjustable mounting pin 80. The step of installing the multi-pin 80 in the channel 74 is not required in those embodiments utilizing an integral multi-pin 80.

In a similar manner as described above, once installed, the pusher body 38 may be retracted away from the mounting plate 34 in a linear fashion within the channel 28 the pusher assembly 10 is contained in. With each subsequent addition of an item of merchandise 24, the pusher body 38 is moved away from the mounting plate 34. As each item 24 of merchandise is removed from the channel 28, the row of merchandise 24 is biased forward by operation of the pusher body 38 and spring 40 until the next item of merchandise 24 engages the front stop 32, or integral front stop 62 in other embodiments.

The embodiments of the invention as illustrated and described provide an apparatus for self-facing retail merchandise in a retail environment that a user may quickly incorporate into permanent or temporary retail environments in a modular fashion.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for self-facing retail merchandise in a retail environment, comprising:

a pusher body, the pusher body including a curved concave pusher face configured for contacting retail merchandise;

a mounting plate, the mounting plate having a bottom surface and a top surface, wherein a section of the bottom surface defines a mounting surface configured for contact with a planar retail support structure, and wherein a first portion of the top surface of the mounting plate is configured for sliding contact with a bottom surface of the pusher body and is not parallel with the mounting surface of the mounting plate;

a spring acting upon the pusher body and the mounting plate, the pusher body being movable toward and away from the mounting plate through extension and retraction of the spring, the pusher body movable toward and away from the mounting plate;

at least one removable fastener adapted to secure the mounting plate directly to the retail environment, the at least one removable fastener having a top surface that is flush with a second portion of the top surface of the mounting plate when the at least one removable fastener is installed in the mounting plate such that retail merchandise simultaneously slidingly engages the top surface of the mounting plate and the top surface of the at least one removable fastener, and wherein the at least one removable fastener extends through both the second portion of the top surface and the bottom surface of the mounting plate; and wherein the mounting plate has a first section and a second section extending rearwardly away from the first section at an obtuse angle such that the pusher body will encounter the second section first as it approaches the mounting plate, the second section having a length longer than the first section, and wherein the mounting plate includes first, second, and third downwardly facing discrete contact surfaces for contacting the planar retail support structure, the first surface provided on the first section, the second and third surfaces provided on the second section.

2. The apparatus of claim 1, further comprising:

a retail shelf having at least one row of apertures proximate a front end thereof, the retail shelf adapted to support the retail merchandise thereon;

the at least one fastener mounting in one of the apertures and securing the mounting plate at the front end of the retail shelf.

3. The apparatus of claim 2, wherein the at least one fastener is at least one pin that resiliently snaps into one of the apertures, the at least one pin having a resiliently flexible retainer portion engaging an underside of the shelf for retention, the resiliently flexible retainer portion contracting to allow for insertion or removal from the aperture and expanding to resiliently mount the mounting plate to the shelf.

4. The apparatus of claim 3, wherein the at least one pin is separately formed apart from the mounting plate, the mounting plate including at least one opening aligning with at least one the apertures; each pin having a head portion and a prong portion extending from the head, the prong portion having a neck disposed in the at least one opening of the mounting plate and the aperture of the shelf, with the resiliently flexible retainer portion on an end of the neck.

5. The apparatus of claim 3, wherein the at least one pin and the mounting plate are unitarily formed.

6. The apparatus of claim 4, wherein the head portion of the at least one pin is disposed of within the at least one opening of the mounting plate when the neck is disposed in the aperture of the retail shelf.

7. The apparatus of claim 2 further comprising a fencing system situated on the retail shelf, the fencing system having at least two divider walls extending rearwardly, a discrete product merchandise channel being formed on the shelf between adjacent ones of the divider walls, and wherein the mounting plate is secured to the retail shelf within said channel.

8. The apparatus of claim 1, wherein the retail environment includes a planar retail merchandise support surface for supporting retail merchandise thereon, and wherein the at least one removable fastener secures the mounting plate directly to the planar retail merchandise support surface of the retail environment, wherein the mounting plate is entirely in direct abutted contact with the planar retail merchandise support surface such that there are no intermediary structures interposed between and contacting the planar retail merchandise support surface and the mounting plate.

9. The apparatus of claim 1, wherein the spring is a coil spring contained along a back side of the pusher body, the coil spring having a free end secured to the mounting plate.

10. The apparatus of claim 9, wherein the mounting plate has a retaining feature extending transversely away from a bottom surface of the mounting plate, wherein an aperture is formed in the free end of the coil spring, the aperture extending through the free end of the coil spring, and receiving the retaining feature of the mounting plate.

11. The apparatus of claim 1 further comprising:

a temporary retail structure having at least one surface adapted to support retail merchandise therein; and the at least one fastener securing the mounting plate to the temporary retail structure.

12. The apparatus of claim 11 wherein the at least one fastener is a pin that punctures the at least one surface, the at least one pin having a resiliently flexible retainer portion engaging an underside of the at least one surface for retention, the resiliently flexible retainer portion contracting to allow for insertion and removal of the aperture and expanding to resiliently mount the mounting plate to the at least one surface.

13. The apparatus of claim 10, wherein the mounting plate has a front portion and a rear portion, said rear portion extending transversely away from an end of the front portion and forming an angle of less than 180° therewith.

14. The apparatus of claim 10, wherein the mounting plate has an integral front stop extending transversely away from a top surface of the front portion of the mounting plate and unitarily formed therewith.

15. An apparatus for self-facing merchandise in a retail environment, comprising:

a retail shelf adapted to support the merchandise thereon;

a shelf divider system mounted to the shelf having at least two divider walls and a front mounting wall arranged generally transverse to the at least two divider walls, the at least two divider walls extending rearwardly, wherein a discrete product merchandise channel is formed on the shelf between adjacent ones of the divider walls and behind the front mounting wall; and a pusher assembly mounted directly to the shelf independently and separately from the shelf divider system, the pusher assembly comprising:

a pusher body, the pusher body including a curved concave pusher face configured for contacting retail merchandise;

a mounting plate mounted directly to the shelf independently and separately from the front mounting wall and the at least two divider walls, the mounting plate disposed entirely within the discrete product merchandise channel and having a top surface and a bottom surface;

a spring acting upon the pusher body and the mounting plate, the pusher body being movable toward and away from the mounting plate through extension and retraction of the spring, the pusher body movable toward and away from the mounting plate;

at least one removable fastener adapted to secure the mounting plate directly to the retail environment, the at least one removable fastener having a top surface that is flush with the top surface of the mounting plate when the at least one removable fastener is installed in the mounting plate such that retail merchandise simultaneously slidingly engages the top surface of the mounting plate and the top surface of the at least one removable fastener, and wherein the at least one removable fastener extends through both the top surface and the bottom surface of the mounting plate; and wherein the mounting plate has a first section and a second section extending rearwardly away from the first section at an obtuse angle such that the pusher body will encounter the second section first as it approaches the mounting plate, the second section having a length longer than the first section, and wherein the mounting plate includes first, second, and third downwardly facing discrete contact surfaces for contacting the planar retail support structure, the first surface provided on the first section, the second and third surfaces provided on the second section.

16. The apparatus of claim 15, wherein the shelf divider system further includes a front wall extending laterally generally over a front end portion of the retail shelf, the divider walls being connected to the front wall.

17. The apparatus of claim 15 wherein the pusher assembly further comprises at least one fastener adapted to secure the mounting plate of the pusher assembly to the retail shelf within the discrete product merchandise channel, the at least one fastener securing the mounting plate independently and separately from the shelf divider system.

18. The apparatus of claim 15, wherein the retail shelf includes a planar retail merchandise support surface for supporting retail merchandise thereon, and wherein the mounting plate is secured directly to the planar retail merchandise support surface of the shelf, wherein the mounting plate is entirely in direct abutted contact with the planar retail merchandise support surface such that there are no intermediary structures interposed between and contacting the planar retail merchandise support surface and the mounting plate.

* * * * *